US010167065B2

(12) United States Patent
Swift et al.

(10) Patent No.: US 10,167,065 B2
(45) Date of Patent: Jan. 1, 2019

(54) AUXILIARY WAKE BALLAST SYSTEM

(71) Applicants: Jeffrey Ralph Swift, Boca Grande, FL (US); William Swift, Billerica, MA (US)

(72) Inventors: Jeffrey Ralph Swift, Boca Grande, FL (US); William Swift, Billerica, MA (US)

( * ) Notice: Subject to any disclaimer, the term of this patent is extended or adjusted under 35 U.S.C. 154(b) by 0 days.

(21) Appl. No.: 15/696,599

(22) Filed: Sep. 6, 2017

(65) Prior Publication Data

US 2018/0154988 A1 Jun. 7, 2018

Related U.S. Application Data

(60) Provisional application No. 62/431,322, filed on Dec. 7, 2016.

(51) Int. Cl.

| | |
|---|---|
| ***B63B 43/06*** | (2006.01) |
| ***B63B 11/04*** | (2006.01) |
| ***B63G 8/22*** | (2006.01) |
| ***B63B 35/85*** | (2006.01) |
| ***B63B 39/03*** | (2006.01) |
| ***B63B 35/73*** | (2006.01) |
| ***B63B 13/00*** | (2006.01) |
| *B63B 35/81* | (2006.01) |

(52) U.S. Cl.

CPC ..... *B63B 43/06* (2013.01); *B63B 11/04* (2013.01); *B63B 13/00* (2013.01); *B63B 35/731* (2013.01); *B63B 35/85* (2013.01); *B63B 39/03* (2013.01); *B63G 8/22* (2013.01); *B63B 2035/818* (2013.01); *B63B 2035/855* (2013.01); *B63B 2207/02* (2013.01); *Y10T 137/85938* (2015.04)

(58) Field of Classification Search

CPC ... B63B 43/06; B63B 2035/818; B63B 39/03; B63B 13/00; B63B 11/04; B63B 35/731; B63B 2207/02; Y10T 137/85938; B63G 8/22

See application file for complete search history.

(56) References Cited

U.S. PATENT DOCUMENTS

| | | | | |
|---|---|---|---|---|
| 5,655,563 A * | 8/1997 | Johnson | B08B 3/00 | 137/115.15 |
| 6,427,616 B1 * | 8/2002 | Hagen | B63B 1/32 | 114/121 |
| 8,798,825 B1 * | 8/2014 | Hartman | B63B 39/03 | 701/21 |
| 2010/0180810 A1 * | 7/2010 | Liberg | B63J 4/002 | 114/125 |

* cited by examiner

*Primary Examiner* — Atif Chaudry
(74) *Attorney, Agent, or Firm* — Cowan, Liebowitz & Latman, P.C.

(57) ABSTRACT

One or more exemplary embodiments comprise a system having: a primary ballast tank; an auxiliary ballast tank; and a Venturi valve having a fluid input channel, a first fluid output channel, and a second fluid output channel that outputs fluid at a pressure that is higher than that of the first fluid output channel, wherein the first fluid output channel of the Venturi valve is coupled to the primary ballast tank for filling the primary ballast tank with fluid, and the second fluid output channel of the Venturi valve is coupled to the auxiliary ballast tank for filling the auxiliary ballast tank with fluid.

20 Claims, 5 Drawing Sheets

AUXILIARY WAKE BALLAST SYSTEM

CROSS-REFERENCE TO RELATED APPLICATION

This application claims priority to U.S. Provisional Patent Application No. 62/431,322, filed Dec. 7, 2016, and entitled "AXILLARY WAKE BALLAST SYSTEM," the entire contents of which are incorporated herein by reference.

INTRODUCTION

Surfing behind boats has become a popular sport. Boats are now equipped with ballast systems to increase their weight and create larger wakes. Many ballast systems are expandable by connecting two or more hoses between the existing ballast system and an auxiliary ballast bag.

However, ballast systems in the bow of the boat cannot use this approach due to low hull height and boat tilt. Therefore, auxiliary systems cannot be mounted in the bow unless they use external pumps for fill and drain. These external pumps are expensive, difficult to use, and do not work well with a factory installed (primary) ballast system.

Filling an auxiliary bow ballast system requires a bow ballast bag and an external pump/control system. This pump may be permanently mounted in the boat with a through-hull connection, or it may be a free pump/hose assembly that is tossed into the water and plugged into an on-board 12V connector. This system is expensive if it is permanently mounted. The system is difficult to use if a pump/hose temporary system is used. In both temporary and permanent installations, the pump control is not integrated into the factory installed system and therefore, there is no access to fluid gauges or controls that exist in the factory installed system.

Moreover, existing auxiliary bow ballast systems are expensive, difficult to fill, and difficult to empty. Most existing solutions require external pumps and an external control system. In addition, existing auxiliary bow ballast systems have no fluid gauge indicating amount of fluid in the tank. Current auxiliary tanks only start to fill once the factory tank reads "full" and thus there is no way to know when the auxiliary tanks are full without visual confirmation. Since these auxiliary tanks are often hidden in boats a visual confirmation can be difficult and awkward.

Therefore, in light of the foregoing problems and deficiencies, an improved system on what currently exists is strongly desired.

It is, therefore, an object of the present description to describe a novel auxiliary bow ballast system that operates from a single hose intercepting the boat's existing bow ballast system. There are no additional pumps necessary to fill or empty the ballast system. Another object of the present description is to describe a boat's bow fill meter that correctly operates indicating whether the bow ballast and auxiliary ballast (together) are full or empty. A further object of the present description is to describe an auxiliary bow ballast system that operates seamlessly with a boat's factory bow ballast system. The existing bow ballast system controls are used to operate the combined factory bow system and auxiliary bow ballast system. Yet another further object of the present description is to describe an auxiliary bow ballast system that can be used with ballast systems in other locations in the boat to provide a lower cost interconnect system that allows the boat ballast level gauges to correctly reflect the full or empty status of each pair of factory/auxiliary tanks.

One exemplary aspect comprises a system comprising: (a) a primary ballast tank; (b) an auxiliary ballast tank; and (c) a Venturi valve having a fluid input channel, a first fluid output channel, and a second fluid output channel that outputs fluid at a pressure that is higher than that of the first fluid output channel, wherein the first fluid output channel of the Venturi valve is coupled to the primary ballast tank for filling the primary ballast tank with fluid, and the second fluid output channel of the Venturi valve is coupled to the auxiliary ballast tank for filling the auxiliary ballast tank with fluid.

In various exemplary embodiments: (1) the primary ballast tank is a factory-installed hard tank and the auxiliary ballast tank is a ballast bag; (2) the Venturi valve is adapted to fill the auxiliary ballast tank with fluid before filling the primary ballast tank with fluid; (3) the system further comprises a fill pump that pumps fluid to the primary ballast tank via the Venturi valve; (4) the system further comprises a fill meter which displays a "full" status only when both the primary ballast tank and the auxiliary ballast tank are full; (5) the primary ballast tank further comprises a vent for emptying fluid contained in the primary ballast tank; (6) the vent empties excess fluid in the primary ballast tank; (7) the system further comprises a drain pump that allows fluid contained in the auxiliary ballast bank to be emptied into the primary ballast tank; (8) the system further comprises a drain Venturi valve that accelerates drainage of the auxiliary ballast tank; (9) the fill meter displays an "empty" status only when both the primary ballast tank and the auxiliary ballast tank are empty; (10) the Venturi valve intercepts an existing fill line of the primary ballast tank; (11) a pressure differential between the first output channel and the second output channel is large enough to overcome a height differential between the primary ballast tank and the auxiliary ballast tank; (12) the system further comprises a one-way valve that prevents the primary ballast tank from emptying when the fill pump is off; and/or (13) the system further comprises a shutoff valve that prevents at least one of the primary ballast tank and the auxiliary ballast tank from emptying during boat operation.

Another exemplary aspect comprises a method for operating an auxiliary ballast tank, the method comprising installing, in a fill line for filling a primary ballast tank with fluid, a Venturi valve having an input channel, a first output channel, and a second output channel that outputs fluid at a pressure that is higher than that of the first output channel, wherein the first output channel of the Venturi valve is connected to the primary ballast bank for filling the primary ballast tank with fluid, and the second output channel of the Venturi valve is connected to the auxiliary ballast bank for filling the auxiliary ballast bank with fluid.

In various exemplary embodiments of the method: (1) the Venturi valve is adapted to fill the auxiliary ballast tank with fluid before filling the primary ballast tank with fluid; (2) the primary ballast tank is a factory-installed hard tank and the auxiliary ballast tank is a ballast bag; (3) a fill meter displays a "full" status only when both the primary ballast tank and the auxiliary ballast tank are filled with fluid; and displays an "empty" status only when both the primary ballast tank and the auxiliary ballast tank are empty; and/or (4) a pressure differential between the first output channel and the second output channel is large enough to overcome a height differential between the primary ballast tank and the auxiliary ballast tank.

Another exemplary aspect comprises a Venturi valve, comprising: (a) a fluid input channel; (b) a first fluid output channel; and (c) a second fluid output channel, wherein the second fluid output channel outputs fluid to an auxiliary ballast tank at a pressure that is higher than that of the first fluid output channel, which outputs fluid to a primary ballast tank, thereby enabling a ballast pump to fill both the auxiliary ballast tank and the primary ballast tank with fluid.

These and other features, aspects, and advantages of specific embodiments will become evident to those skilled in the art from a reading of the description herein and the appended drawings.

BRIEF DESCRIPTION OF THE DRAWINGS

The present invention will be better understood when considered in view of the attached drawings, in which like reference characters indicate like parts. The drawings, however, are presented merely to illustrate certain exemplary embodiments without limiting the invention any manner whatsoever.

DETAILED DESCRIPTION OF SELECT EXEMPLARY EMBODIMENTS

Figure 1A:
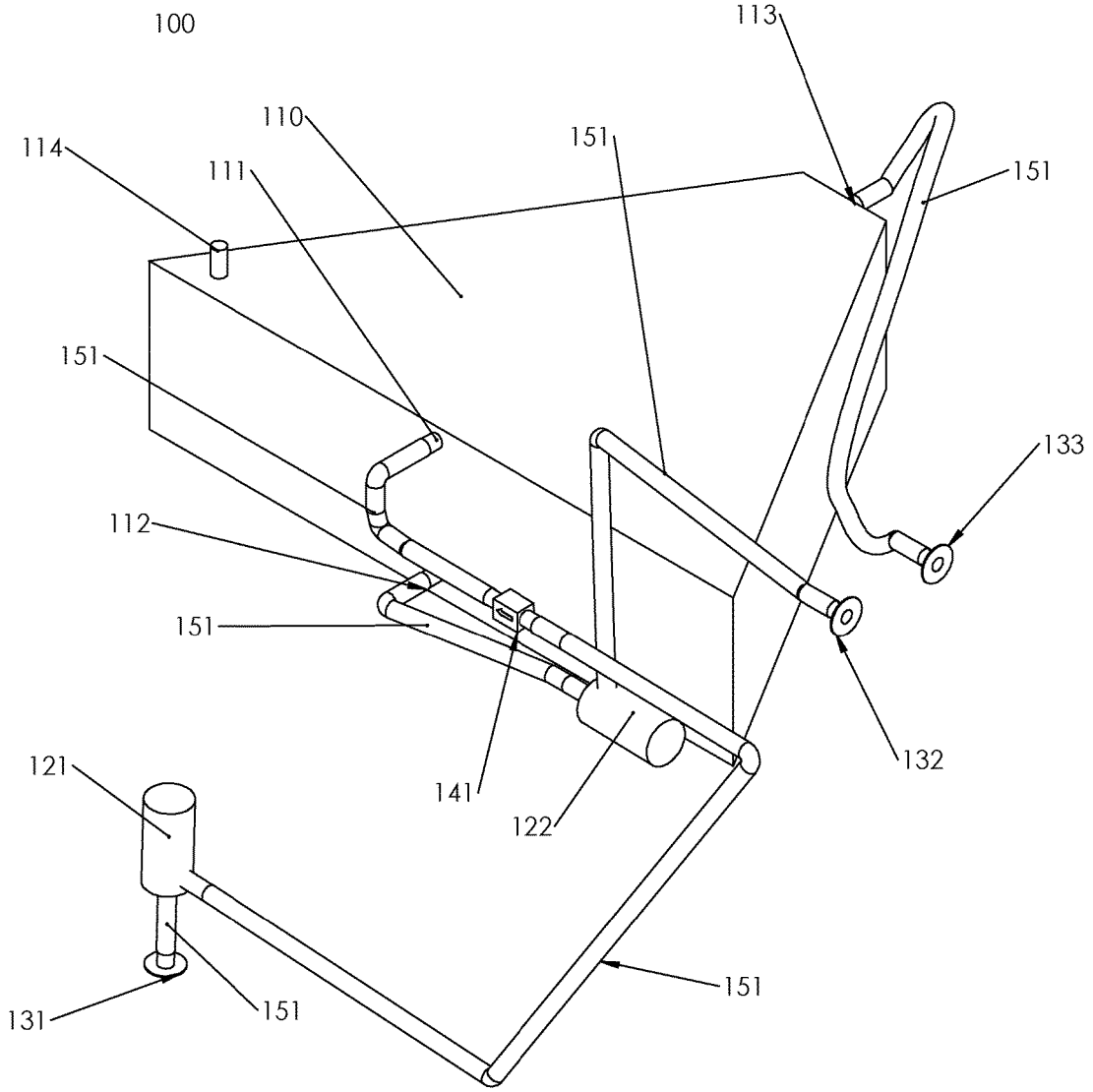
FIG. 1A PRIOR ART
FIG. 1A is a diametric view of an existing factory installed ballast system.

The following text sets forth a broad description of numerous different embodiments of the present disclosure. The description is to be construed as exemplary only and does not describe every possible embodiment since describing every possible embodiment would be impractical, if not impossible. It will be understood that any feature, characteristic, component, composition, ingredient, product, step, or methodology described herein can be deleted, combined with or substituted for, in whole or part, any other feature, characteristic, component, composition, ingredient, product, step or methodology described herein. Numerous alternative embodiments may be implemented, using either current technology or technology developed after the filing date of this patent, which would still fall within the scope of the claims. All publications and patents cited herein are incorporated herein by reference.

In one exemplary embodiment, a Venturi valve is provided between a factory installed bow ballast tank and an auxiliary ballast tank (or bag—the terms are used interchangeably herein, for simplicity, and the use of either term should be understood to include either a tank or a bag).

A Venturi valve creates a pressure differential in a gas or fluid by constricting the flow such that in the region of the restriction the fluid or gas is moving faster than that outside the region of constriction. The Bernoulli Principle dictates that a region of faster flowing gas or fluid must have a lower pressure than a region of slower moving gas or fluid.

A Venturi valve typically is designed to receive an input in the larger, slower moving section of the valve. This input will be directed through a constricted, faster moving section of the valve and then into another slower moving section. The larger, slower-moving section following the restriction is used as the main output of the Venturi valve.

The Venturi valve may have one or more connections to the restricted, faster moving section of the valve. This (these) connection(s) can be either inputs or outputs, depending upon the specific design of the Venturi valve. For example, if the restricted area connection were left open to the air, and the pressure in the restricted region of the Venturi is lower than atmospheric pressure, then air will be drawn into the Venturi and this restricted area connection would be used as a second input to the Venturi valve. In this same example, with different venture design parameters, if the resulting pressure in the restricted area is greater than atmospheric pressure, then fluid will be pushed out of the restricted area connection, although at a lower pressure than the fluid exiting the Venturi valve main output.

In one embodiment a Venturi valve has three connections: (1) a larger diameter input and corresponding larger output; (2) a smaller diameter channel connecting the larger diameter input and output; and (3) a third output protruding from the smaller diameter section of the valve. Bernoulli's principle dictates that a difference between inside diameters of a multi-diameter pipe along with a fluid flow rate will create a pressure differential between the larger diameter sections and the smaller diameter section. This pressure differential is used to fill the auxiliary ballast bag (mounted above the factory installed tank) before the factory installed tank is filled.

The factory installed tank has one or more pumps that push water through the Venturi valve which directs low pressure to the bottom factory tank and a higher pressure to the top auxiliary tank. The higher pressure output will fill the auxiliary tank first. When the top auxiliary tank is full, the flow at the output of the valve stops, and all additional fluid is directed to the factory installed tank. This allows the factory fill meter to register "full," only when both tanks are full. Those skilled in the art will understand that in other embodiments, both tanks may be filled simultaneously, or the factory tank may fill up just before the auxiliary tank. In either case, the end result is that when the factory fill meter says that the factory tank is full, both tanks are full.

When the factory bow ballast tank is emptied, by force of gravity, fluid flows from the auxiliary bow ballast tank through the Venturi valve into the factory bow ballast tank. This operation allows the bow ballast level indicator to register "empty" only when both ballast tanks are empty.

The Venturi valve intercepts the existing factory bow ballast fill line. The low pressure output of the Venturi valve then feeds the factory installed ballast tank. The high pressure output of the Venturi valve feeds the auxiliary bow ballast bag. The specifications of the Venturi valve are determined by the Bernoulli equation so that the pressure differential created is large enough to overcome the height differential between the auxiliary bow ballast bag and the factory installed ballast tank. This way, the auxiliary bag fills first and only after it is full, fluid is directed to the factory ballast tank.

The gauges and controls of the factory installed ballast system operate as they were intended to operate, except a "full" indication means that both the factory installed ballast tank and the auxiliary tank are full. When emptying the factory bow ballast tank, the Venturi valve allows water from the auxiliary bow ballast to empty via gravity into the factory bow ballast system. The factory bow ballast system only empties fully when both the factory installed ballast system and the auxiliary ballast system are empty. When both ballast systems are full, it is possible in some boats with low hull heights to allow fluid to drain from the auxiliary bow ballast system into the factory bow ballast system and then travel out of the boat through the factory bow ballast overflow fitting or drain fitting.

In these cases, there are solutions to lose the ballast. The first case is to leave the fill pump on, which keeps the Venturi valve from emptying. The second solution is to install a shutoff valve going to the auxiliary bow ballast system so that fluid cannot drain out when the shutoff valve is closed.

To implement one or more embodiments, it is necessary to size a Venturi valve such that the fluid velocity created by the fill pump will create a pressure differential that is larger than that created by the height differential between the auxiliary bow ballast system and the factory bow ballast system. The Venturi valve may be installed to intercept the existing factory bow ballast system feed line. Appropriate hoses can be installed to complete the connection to the factory bow ballast system and to the auxiliary bow ballast system. The Venturi valve is then used to redirect water from the fill pump to the auxiliary bow ballast system and allow water to fill the factory bow ballast system only when the auxiliary bow ballast system is full.

In one embodiment, a shutoff valve is optionally used to prevent water drainage during boat operation. In another embodiment, a drain Venturi valve can also be installed to accelerate the auxiliary bow ballast drainage which otherwise would operate through gravity drainage alone. In yet another embodiment, quick-connect connectors can be installed so that the auxiliary bow ballast system can be removed and stored (if a flexible bow ballast bag is used). During such storage, a quick-connect cap can be installed where the bag was connected such that the factory bow ballast system reverts back to its original form and function.

Referring now to the drawings, FIG. 1A depicts an example of a factory installed ballast system. In FIG. 1A, a hard tank 110 holds the ballast and has connected thereto: a fill (or filling) connector 111, an empty (or drain) connector 112 and a vent 113. As also shown in FIG. 1A, a fill pump 121 draws water through a first through-hull connector 131 and pumps the water through a one-way valve 141 into the fill connector 111. The fill pump 121 and the through-hull connector 131 are located below the water line so that low cost, high capacity pumps can be used. An above water line pump is generally not used because it would need to be self-priming, and therefore would be more costly and generally lower capacity.

In one exemplary embodiment, the one-way valve 141 is used to prevent the tank from emptying when the fill pump 121 is turned off. The one-way valve 141 can be replaced with an anti-siphon loop if the anti-siphon loop is located higher than any portion of the tank 110 while under operation. In bow installations, it is often difficult or impossible to locate the anti-siphon loop higher than the bow tank when the boat is operating at partial plane and therefore a one-way valve such as the one-way valve 141 is often used.

The vent 113 may be connected to a through-hull fitting 133. The vent 113 allows air inside the tank 110 to be displaced with water during tank fill and empty operations. The vent 113 also acts as an overflow for excess ballast. The through-hull fitting 133 is located on the hull at a point higher than any portion of the tank 110 during any mode of boat operation to prevent the tank 110 from emptying during normal boat operation.

A drain pump 122 draws water from the drain connector 112 and pumps the water out through a second through-hull connector 132. The second through-hull connector 132 goes through the boat hull at a location higher than any portion of the tank 100 will be during boat operation so that the tank 110 does not inadvertently drain during normal boat operation. The drain pump 122 is located below the tank 110 and below the water line so that this pump can be a low cost, high capacity, non-self priming pump. However, water can pass easily through non-self priming pumps when they are turned off, and thus improper through-hull connector location may allow the tank 110 to inadvertently drain.

Although not shown in FIG. 1A, the tank 110 has a fluid level indicator inside the tank 110. The fluid level indicator transmits information to the boat operator as to the amount of fluid in the tank 110.

A connector 114 as shown in FIG. 1A is not typically available on current bow ballast systems but is shown here for information purposes only. The connector 114 is present generally in rear ballast systems where through-hull overflow and drain fittings are mounted at a location higher than a auxiliary ballast bag sitting above the ballast tank 110. The high mounting locations allow for an auxiliary soft ballast bag to connect to the connector 114 and operate as a supplemental ballast bag. During a fill operation, the factory ballast tank 110 fills first and then excess water flows through the connector 114 into the auxiliary bag. When the auxiliary bag is full, excess water can then be sent out through the connector 114. During a drain operation, the auxiliary bag drains into the tank 110 through the connector 114. The auxiliary tank expands and collapses during fill and drain operations and thus does not need a vent. After the auxiliary tank has drained completely, the tank 110 empties thereafter.

Ballast installations in the bow rarely have adequate height to locate the first and second through-hull connectors 132 and 133 high enough to accommodate an auxiliary ballast bag. Therefore, the connector 114 is seldom available for bow ballast installations.

In ballast systems that use a connector such as the connector 114 to operate an auxiliary ballast soft bag, the system does not exhibit correct operation of the ballast fluid level indicator gauge. Since the factory tank fills first, the fill gauge reads "full" before the auxiliary tank has even started filling. In this configuration, there is no way to know when the auxiliary soft ballast bag is full without visually inspecting the bag. Visual inspection can be difficult or awkward when the soft ballast bag is located in hidden boat compartments.

Figure 1B:
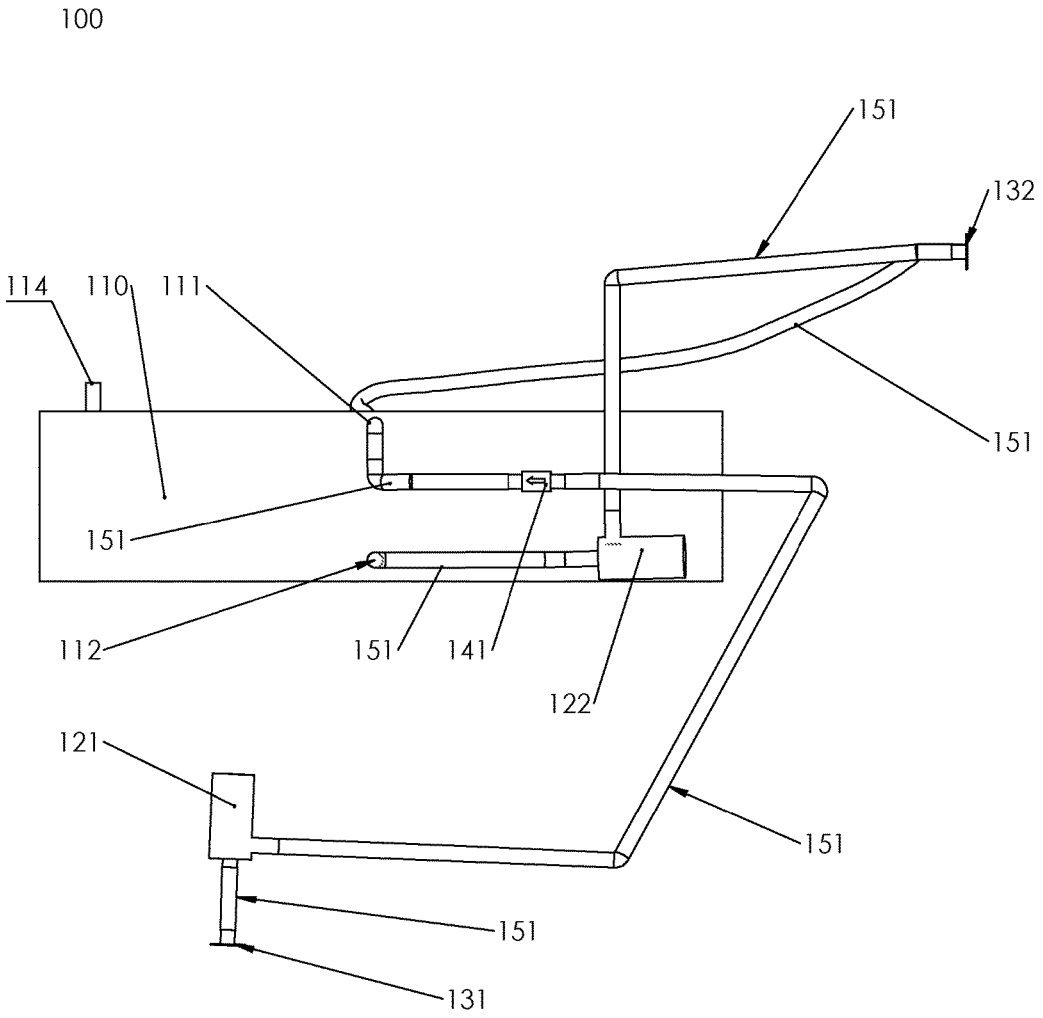
FIG. 1B PRIOR ART
FIG. 1B is a rear view of the existing factory installed ballast system shown in FIG. 1A.

FIG. 1B is a rear view of the factory installed ballast system as shown in FIG. 1A. FIG. 1B does not include any additional elements that were not shown via FIG. 1A. Therefore, any further description of FIG. 1B will be omitted.

Figure 2:
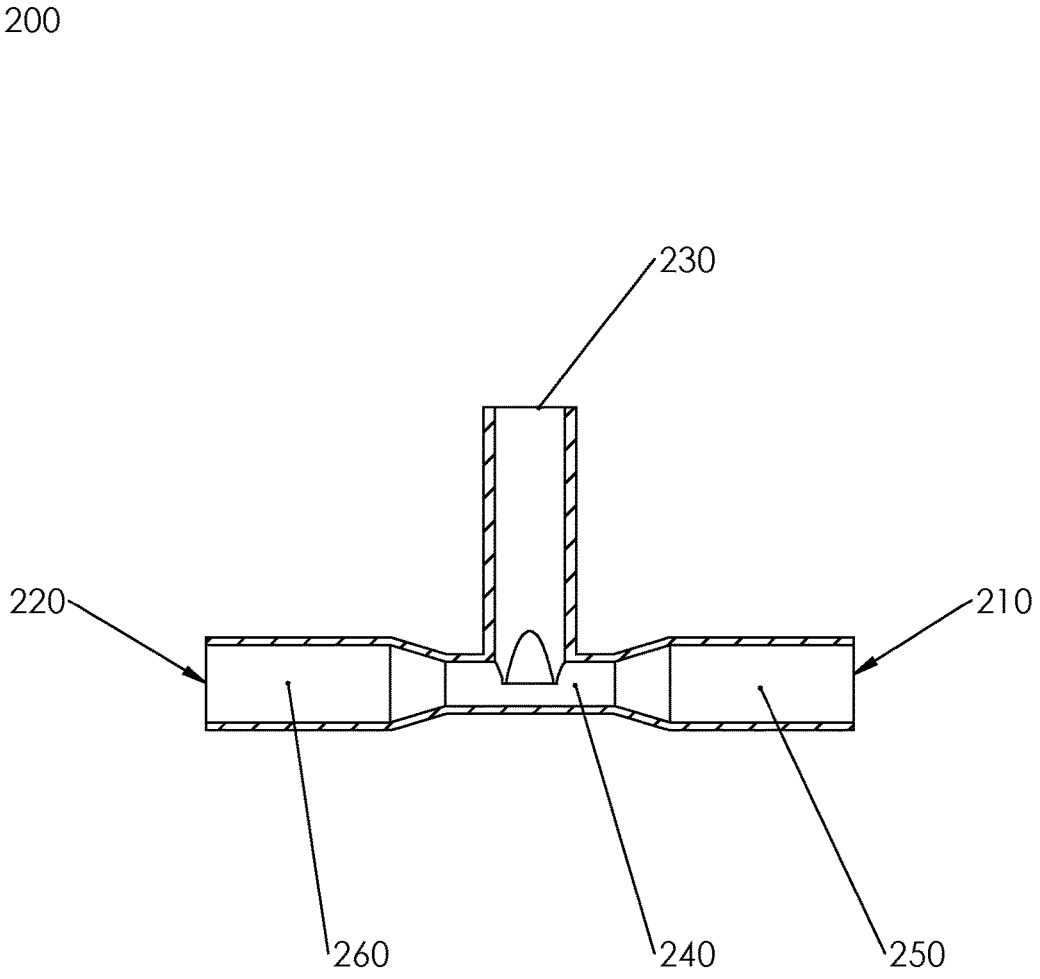
FIG. 2 is a cut-out view of a Venturi valve in accordance with an embodiment of the present invention.

FIG. 2 shows a cutout of a Venturi valve 200 of an embodiment. The Venturi valve 200 has an input connector 210 feeding a first large cross-sectional area 250. The first large cross-sectional area 250 feeds a small cross-sectional area 240 where a low pressure exit connector 230 is located. The small cross-sectional area 240 also feeds a second large cross-sectional area 260 where high pressure output connector 220 is located. The Venturi valve 200 operates under Bernoulli's principle that as fluid increases its velocity in a closed system, it must decrease its pressure. Those skilled in the art will understand that the difference in cross sectional areas between the areas 250/260 and the area 240, when combined with a selected fluid velocity in the area 250, will create a pressure differential between the output connectors 230 and 220. The cross-sectional areas and fluid velocity can be selected such that the fluid coming from the input connector 220 travels much higher in a gravitational field than the fluid coming from the connector 230. Design parameters can be selected such that the connector 220 can fill a higher soft tank first, even though that soft tank is located above a hard tank being filled simultaneously from the connector 230.

Figure 3A:
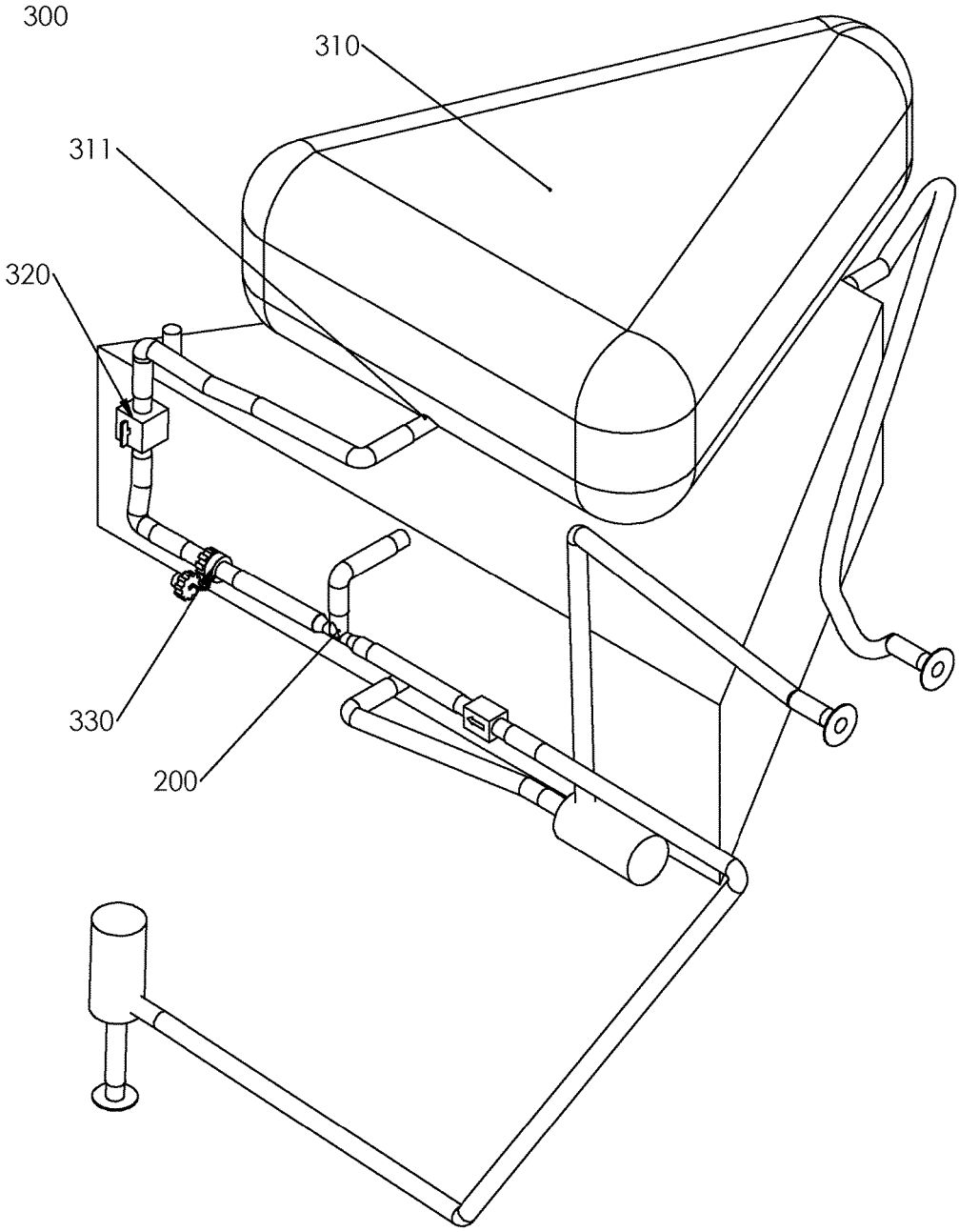
FIG. 3A is a diametric view of an auxiliary ballast system in accordance with an embodiment of the present invention.
Figure 3B:
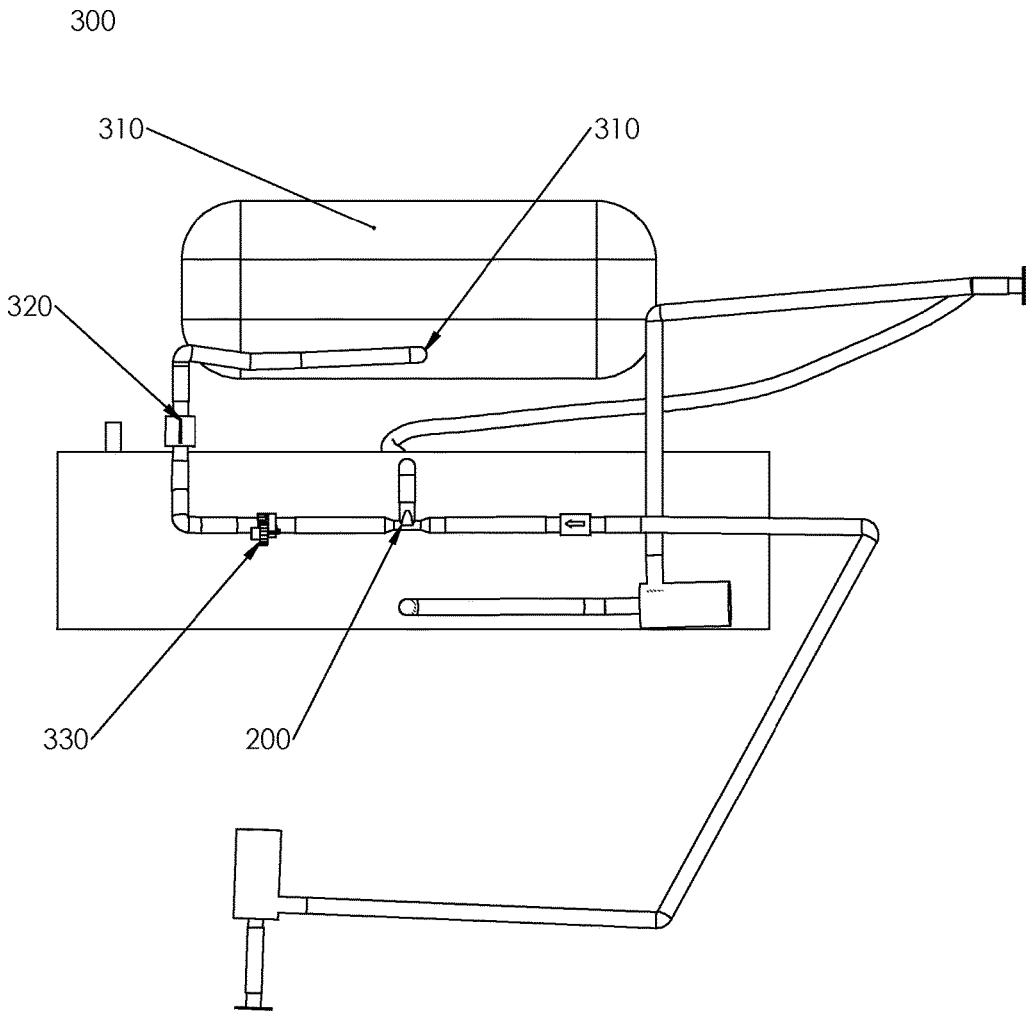
FIG. 3B is a rear view of the auxiliary ballast system shown in FIG. 3A.

FIG. 3 shows an auxiliary bow ballast system 300 in accordance with an exemplary embodiment. In FIG. 3, an auxiliary ballast bag 310 is located in the bow above an existing factory ballast system. The location may be on top of the bow seats, but can also be in any location above the factory tank. The auxiliary ballast bag 310 includes a fill/empty connector 311. The fill/empty connector 311 is connected to an optional shut-off valve 320, which is in turn connected to an optional quick-connect assembly 330. The quick-connect assembly 330 is then connected to the Venturi valve 200 as described above in reference to FIG. 2.

To install the auxiliary bow ballast system 300, the connection between the one-way valve 141 and the tank fill connector 111 as shown in FIG. 1A is intercepted with a Venturi valve 200. The input connector 210 is connected to the one-way valve 141 and the low pressure connector 230 is connected to the fill connector 111. The high pressure connector 220 feeds to the optional quick-connect assembly 330. The quick-connect assembly 330 is often mounted through a boat panel. The quick-connect assembly 330 enables easy mounting and dismounting of the auxiliary ballast system. The quick-connect assembly 330 separates and allows the auxiliary ballast bag 310 to be removed and stored. The quick-connect assembly 330 may further include a cap to close off the quick connect assembly 330 after removal of the auxiliary ballast bag 310 and restores normal bow ballast operation when the auxiliary ballast system is not present.

The auxiliary bow ballast bag 310 may be located higher than the factory installed through-hull fitting 133 due to boat design constraints. Normal auxiliary ballast system operation through the connector 114 is impaired by these design constraints and auxiliary bow ballast systems are generally not available to operate off the factory pumps.

Operation of the auxiliary bow ballast bag 310 from the factory ballast system is enabled by the Venturi valve 200 automatically diverting water at a higher pressure to the auxiliary soft bag 310. The factory ballast tank 110 does not fill until the auxiliary bow ballast bag 310 is full. Additionally, the ballast fluid gauge reads full only when both the auxiliary and the factory tanks are "full." Similarly, during a drain operation, gravity drives fluid from the auxiliary soft tank 310 into the factory tank 110 via the Venturi valve 200. When both the auxiliary ballast bag 310 and the factory hard tank 110 are emptied, the ballast gauge reads "empty."

When both the factory ballast tank 110 and the auxiliary ballast bag 310 are full, the excess fill water flows from the through-hull fitting 133. There are normally portions of the auxiliary ballast bag 310 that are higher than the through-hull fitting 133 or the second through-hull 132. When the fill pump 121 is turned off, gravity pushes water from the auxiliary ballast bag 310 through the Venturi valve 200 into the hard ballast tank 110 and then out via the vent 113 and the through-hull fitting 133. This means that the auxiliary bow ballast bag 310 will start to empty during normal boat operation when the fill pump 121 is shut off. To prevent the auxiliary bow ballast bag 310 from self-emptying during normal boat operation, the optional shutoff valve 320 is installed in line with the auxiliary ballast bag 310. The shutoff valve 320 is a non-restrictive type valve such as a ball valve that does not reduce pressure significantly. The shutoff valve 320 is shut off during normal boat operation and opened during ballast fill/empty operation.

If the optional shutoff valve 320 is not installed, then the auxiliary bow ballast bag 310 can remain filled during normal boat operation by simply leaving the fill pump 121 "on". Although excess fill water is pumped out via the through-hull fitting 133, the Venturi valve 200 maintains a pressure differential and keeps the auxiliary ballast bag 310 full.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or any combination with any other reference or references, teaches, suggests, or discloses any such invention. Further, to the extent conflicts with any meaning or definition of a term in this document conflicts with any meaning or definition of the same term in a document incorporated by reference, the meaning or definition assigned to that term in this document shall govern.

While particular embodiments of the present invention have been illustrated and described, those skilled in the art will recognize that various other changes and modifications can be made without departing from the spirit and scope of the invention. It is therefore intended to cover in the appended claims all such changes and modifications that are within the scope of this invention.

We claim:

1. A system comprising:

a primary ballast tank;

an auxiliary ballast tank; and a Venturi valve having a fluid input channel, a first fluid output channel, and a second fluid output channel that outputs fluid at a pressure that is higher than that of the first fluid output channel, wherein the first fluid output channel of the Venturi valve is coupled to the primary ballast tank for filling the primary ballast tank with fluid, and the second fluid output channel of the Venturi valve is coupled to the auxiliary ballast tank for filling the auxiliary ballast tank with fluid.

2. The system of claim 1, wherein the primary ballast tank is a factory-installed hard tank and the auxiliary ballast tank is a ballast bag.

3. The system of claim 1, wherein the Venturi valve is adapted to fill the auxiliary ballast tank with fluid before filling the primary ballast tank with fluid.

4. The system of claim 1, wherein the system further comprises a fill pump that pumps fluid to the primary ballast tank via the Venturi valve.

5. The system of claim 4, further comprising a fill meter which displays a "full" status only when both the primary ballast tank and the auxiliary ballast tank are full.

6. The system of claim 1, wherein the primary ballast tank further comprises a vent for emptying fluid contained in the primary ballast tank.

7. The system of claim 6, wherein the vent empties excess fluid in the primary ballast tank.

8. The system of claim 1, further comprising a drain pump that allows fluid contained in the auxiliary ballast bank to be emptied into the primary ballast tank.

9. The system of claim 1, further comprising a drain Venturi valve that accelerates drainage of the auxiliary ballast tank.

10. The system of claim 5, wherein the fill meter displays an "empty" status only when both the primary ballast tank and the auxiliary ballast tank are empty.

11. The system of claim 1, wherein the Venturi valve intercepts an existing fill line of the primary ballast tank.

12. The system of claim 1, wherein a pressure differential between the first output channel and the second output channel is large enough to overcome a height differential between the primary ballast tank and the auxiliary ballast tank.

13. The system of claim 1, further comprising a one-way valve that prevents the primary ballast tank from emptying when the fill pump is off.

14. The system of claim 1, further comprising a shutoff valve that prevents at least one of the primary ballast tank and the auxiliary ballast tank from emptying during boat operation.

15. A method for operating an auxiliary ballast tank, the method comprising:

installing, in a fill line for filling a primary ballast tank with fluid, a Venturi valve having an input channel, a first output channel, and a second output channel that outputs fluid at a pressure that is higher than that of the first output channel, wherein the first output channel of the Venturi valve is connected to the primary ballast bank for filling the primary ballast tank with fluid, and the second output channel of the Venturi valve is connected to the auxiliary ballast bank for filling the auxiliary ballast bank with fluid.

16. The method of claim 15, wherein the Venturi valve is adapted to fill the auxiliary ballast tank with fluid before filling the primary ballast tank with fluid.

17. The method of claim 15, wherein the primary ballast tank is a factory-installed hard tank and the auxiliary ballast tank is a ballast bag.

18. The method of claim 15, wherein a fill meter displays a "full" status only when both the primary ballast tank and the auxiliary ballast tank are filled with fluid; and displays an "empty" status only when both the primary ballast tank and the auxiliary ballast tank are empty.

19. The method of claim 15, wherein a pressure differential between the first output channel and the second output channel is large enough to overcome a height differential between the primary ballast tank and the auxiliary ballast tank.

20. A Venturi valve in a ballast system, comprising:

a fluid input channel;

a first fluid output channel; and a second fluid output channel, wherein the second fluid output channel is coupled to an auxiliary ballast tank and outputs fluid to the auxiliary ballast tank at a pressure that is higher than that of the first fluid output channel, which is coupled to a primary ballast tank and outputs fluid to the primary ballast tank, thereby enabling a ballast pump to fill both the auxiliary ballast tank and the primary ballast tank with fluid.

* * * * *